US011846418B2

(12) United States Patent
Robertson et al.

(10) Patent No.: US 11,846,418 B2
(45) Date of Patent: Dec. 19, 2023

(54) PROTECTIVE MATERIAL FOR FUEL SYSTEM

(71) Applicant: Robertson Intellectual Properties, LLC, Mansfield, TX (US)

(72) Inventors: Michael C. Robertson, Arlington, TX (US); Antony F. Grattan, Arlington, TX (US); Douglas J. Streibich, Arlington, TX (US); Cory L. Huggins, Arlington, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 851 days.

(21) Appl. No.: 16/728,883

(22) Filed: Dec. 27, 2019

(65) Prior Publication Data

US 2020/0208483 A1 Jul. 2, 2020

Related U.S. Application Data

(63) Continuation-in-part of application No. 16/725,555, filed on Dec. 23, 2019, now abandoned.

(60) Provisional application No. 62/785,893, filed on Dec. 28, 2018.

(51) Int. Cl.

| | |
|---|---|
| ***E21B 29/02*** | (2006.01) |
| ***F23M 5/00*** | (2006.01) |
| ***E21B 43/11*** | (2006.01) |
| ***F23D 14/42*** | (2006.01) |

(52) U.S. Cl.

CPC ..... *F23M 5/00* (2013.01); *E21B 29/02* (2013.01); *E21B 43/11* (2013.01); *F23D 14/42* (2013.01); *F23B 2900/00003* (2013.01); *F23D 2201/30* (2013.01); *F23D 2209/00* (2013.01); *F23D 2212/00* (2013.01); *F23M 2700/008* (2013.01); *F23M 2900/05003* (2013.01)

(58) Field of Classification Search

CPC ..... F23M 5/00; F23M 2700/008; F23M 2900/05003; E21B 29/02; E21B 43/11; E21B 33/13; E21B 36/008; F23D 14/42; F23D 2201/30; F23D 2209/00; F23D 2212/00; F23B 2900/00003

USPC ..... 102/531, 331; 166/63, 165, 264, 381

See application file for complete search history.

(56) References Cited

U.S. PATENT DOCUMENTS

| | | | | |
|---|---|---|---|---|
| 8,839,871 | B2 * | 9/2014 | Wright | E21B 47/06 166/383 |
| 9,228,412 | B2 * | 1/2016 | Lowry | E21B 33/134 |
| 9,394,757 | B2 * | 7/2016 | Lowry | E21B 33/13 |
| 10,145,203 | B2 * | 12/2018 | Carragher | E21B 33/136 |
| 10,246,961 | B2 * | 4/2019 | Robertson | E21B 23/06 |
| 10,370,931 | B2 * | 8/2019 | Carragher | E21B 36/008 |

(Continued)

*Primary Examiner* — Michael D David

(74) *Attorney, Agent, or Firm* — McCutcheon Joseph, PLLC

(57) ABSTRACT

A downhole torch system and method of use includes a cylindrical housing, a protective material provided on at least one of the cylindrical housing and the fuel load, and a fuel load located within the cylindrical housing. The protective material is provided between the fuel load and the cylindrical housing to protect the cylindrical housing from adverse effects caused by the reaction of the burning fuel and/or the subsequent production of combustion products for cutting and/or perforating processes during operation of the torch system. The protective material significantly improves the cutting and/or perforating performance of the torch system.

19 Claims, 1 Drawing Sheet

(56) References Cited

U.S. PATENT DOCUMENTS

| | | | | |
|---|---|---|---|---|
| 10,801,301 | B2 * | 10/2020 | Carragher | E21B 33/134 |
| 11,053,783 | B2 * | 7/2021 | Montoya Ashton | E21B 23/0414 |
| 11,199,067 | B2 * | 12/2021 | Carragher | E21B 33/12 |
| 11,401,776 | B2 * | 8/2022 | Carragher | E21B 36/00 |
| 2011/0132223 | A1 * | 6/2011 | Streibich | E21B 23/065 102/531 |
| 2015/0275643 | A1 * | 10/2015 | Holder | G01N 29/04 166/63 |
| 2018/0163497 | A1 * | 6/2018 | Younger | E21B 43/105 |

* cited by examiner

PROTECTIVE MATERIAL FOR FUEL SYSTEM

CROSS REFERENCE TO RELATED APPLICATIONS

This application is a non-provisional application that claims priority to U.S. Provisional Application No. 62/785,893, filed Dec. 28, 2018 and having the title of "Protective Material for Fuel System," and a continuation-in-part of, which claims priority to and the benefit of, U.S. patent application Ser. No. 16/725,555, filed Dec. 23, 2019 and having the title of "Protective Material for Fuel System," both of which are hereby incorporated by reference herein in their entireties.

FIELD OF THE INVENTION

The present application relates, generally, to downhole cutting and/or perforating systems involving thermite or similar fuel as a cutting or working output medium. More specifically, the application relates to a material that selectively protects the internal surface of a fuel housing from the thermal and abrasive properties of the fuel.

BACKGROUND

Downhole torch systems include a cylindrical housing that can house and contain fuel, such as thermite fuel pellets or other combustible fuel pellets including propellants. The cylindrical housing can often become adversely affected by the localized heating and flow induced during the burning of the fuel. In some situations, the fuel is held up for enough time that the wall of the cylindrical housing is completely eroded. In extreme cases, this heating of the cylindrical housing can adversely affect the performance of the torch and can reduce the overall effectiveness of the torch. In addition, this problematic heating of the cylindrical housing can affect the design of the torch, as the amount of fuel and duration of the reaction is considered and manipulated in order to avoid the catastrophic erosion condition.

Conventional torches are designed with the fuel loaded in intimate or direct contact with the torch system, e.g., against the inner surface of the cylindrical housing. This design allows the fuel to be loaded into the torch housing directly, but the design offers no protection to the cylindrical wall against the effects of the molten fuel (combustion products). For situations where the amount of fuel does not exceed a critical mass, the discharge of the fuel (e.g., molten fuel or plasma, combustion products) can occur with no detrimental effect to the cylindrical housing. However, in situations where the amount of fuel exceeds a critical mass, the risk of damage to the cylindrical housing is increased.

This damage occurs to the cylindrical housing due to excessive heat and the erosive effects of the combustion products as they travel down through the bore of the torch system. In the event where the cylindrical housing wall is breached prior to the complete discharge, the high pressure cutting stream of the molten fuel (e.g., molten fuel or plasma, combustion products) is significantly diminished and does not have sufficient energy to complete the cutting, perforating or other beneficial work output process. That is, some of the pressurized stream exits the breach in the housing wall, which can diminish the sufficiency of the cutting and/or perforating processes.

A new torch system is needed that can protect the cylindrical housing of the torch from the adverse effects of the ignition and reaction of the burning fuel, and the subsequent production of combustion products (molten fuel) during operation of the torch system. A new torch system is needed that significantly improves the cutting and/or perforating performance of the torch system.

The features of the following torch system meet these needs.

SUMMARY

The inventors of the present application have developed a material to protect the cylindrical housing from the adverse effects of the combustion products (molten fuel) during operation of the torch system, thus significantly improving the cutting and/or perforating performance of the torch system. The material protects the cylindrical housing from the excessive heat and erosive effects of the combustion products. The material therefore improves the efficiency, cutting and/or perforating capability and mechanical integrity of the torch system. In some instances, the material may be of a type that decays and integrates into the combustion products. This integration into the combustion products can provide the same combustion product, or produce a second combustion product or an added layer of combustion. In other instances, the material may include a retardant that cools the exothermic reaction of the combustion products to provide a quenching effect, which can further protect the housing from excessive heat and erosion produced by the combustion products. Further, the material may be doped or altered with a tracer material that is not consumed or degraded by the combustion products and that serves as an indicator after the cutting and/or perforating process to, for example, verify the location, depth, presence or absence, and/or quality of the cut or perforation.

In one embodiment, a downhole torch system comprises: a cylindrical housing; a fuel load located within the cylindrical housing; and a protective material provided between the fuel load and the cylindrical housing.

In an embodiment, the protective material can be a carbon fiber tight mesh weave.

In an embodiment, the protective material can be formed of Kevlar, glass fiber, ceramics, carbon (e.g., graphite), polymers, epoxy, or combinations thereof.

In an embodiment, the protective material is a continuous layer between the fuel load and the cylindrical housing.

In an embodiment, the protective material can be provided on an outer surface or an outer layer of the fuel load. In the same or an alternative embodiment, the protective material can be provided on an inner surface of the cylindrical housing.

In an embodiment, the fuel load can be configured to create an exothermic reaction that produces a stream of combustion products when the fuel load is ignited, and the protective material can comprise material that is configured to integrate into the stream of combustion products after the fuel load is ignited.

In an embodiment, the fuel load can be configured to create an exothermic reaction that produces a stream of combustion products when the fuel load is ignited, and the protective material can comprise a retardant that is configured to quench the stream of combustion products adjacent the protective material.

In an embodiment, the fuel load can be configured to create an exothermic reaction that produces a stream of combustion products when the fuel load is ignited, and the protective material can comprise a tracer material that is not degraded by the stream of combustion products and is detectable after cutting and/or perforating by the torch assembly.

Another embodiment involves a method of assembling a downhole torch system. The downhole torch system comprises a cylindrical housing, a fuel load, and a protective material. The steps of the method comprise providing the protective material on at least one of the cylindrical housing and the fuel load, and inserting the fuel load into the cylindrical housing.

In an embodiment, the method steps can further include providing the protective material on an outer surface or outer layer of the fuel load before inserting the fuel load into the cylindrical housing. In the same or an alternative embodiment, the method steps can further include providing the protective material on an inner surface of the cylindrical housing before inserting the fuel load into the cylindrical housing.

In an embodiment, the protective material can be a carbon fiber tight mesh weave.

In an embodiment, the protective material can be formed of Kevlar, glass fiber, ceramics, carbon, polymer, epoxy, or combinations thereof.

In an embodiment, the steps of the method can continue by configuring the fuel load to create an exothermic reaction that produces a stream of combustion products when the fuel load is ignited, and the protective material can comprise a material that can be configured to integrate into the stream of combustion products after the fuel load is ignited. This integration into the combustion products can provide the same combustion product, or produce a second combustion product or an added layer of combustion of the fuel load.

In an embodiment, the steps of the method can continue by configuring the fuel load to create an exothermic reaction that produces a stream of combustion products when the fuel load is ignited, and quenching the stream of combustion products adjacent the protective material with the protective material comprising a retardant, which is configured to quench the stream of combustion products adjacent the protective material.

In an embodiment, the steps of the method can continue by configuring the fuel load to create an exothermic reaction that produces a stream of combustion products when the fuel load is ignited, and the protective material can comprise a tracer material that is not degraded by the stream of combustion products and is detectable after cutting and/or perforating by the torch assembly.

DESCRIPTION

Before explaining selected embodiments of the present invention in detail, it is to be understood that the present invention is not limited to the particular embodiments described herein and that the present invention can be practiced or carried out in various ways.

Figure 1:
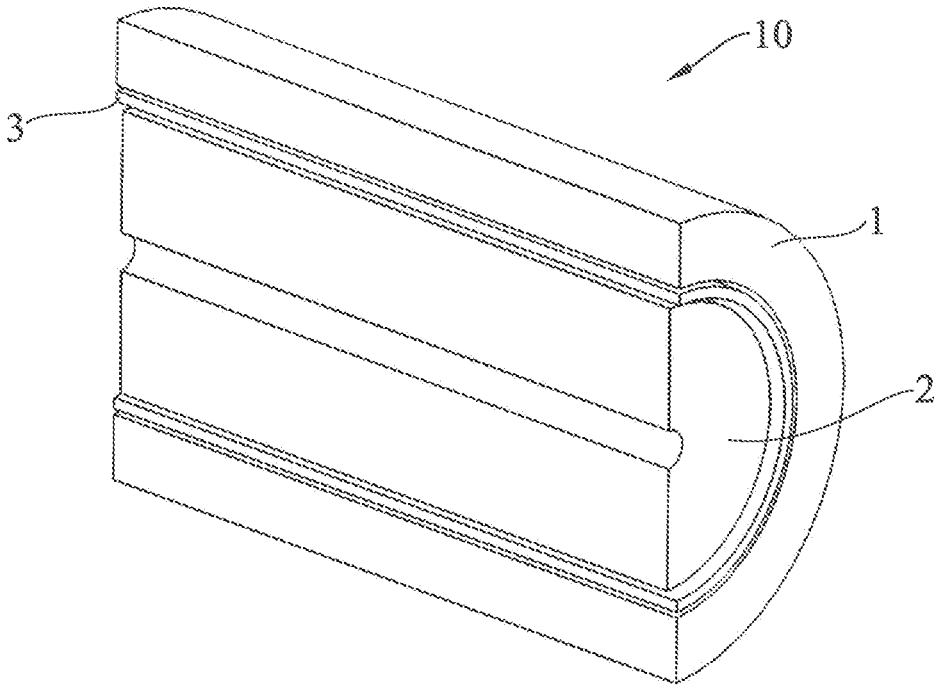
FIG. 1 illustrates an isometric cut-away view of a portion of torch system 10 of the present invention.
Figure 2:
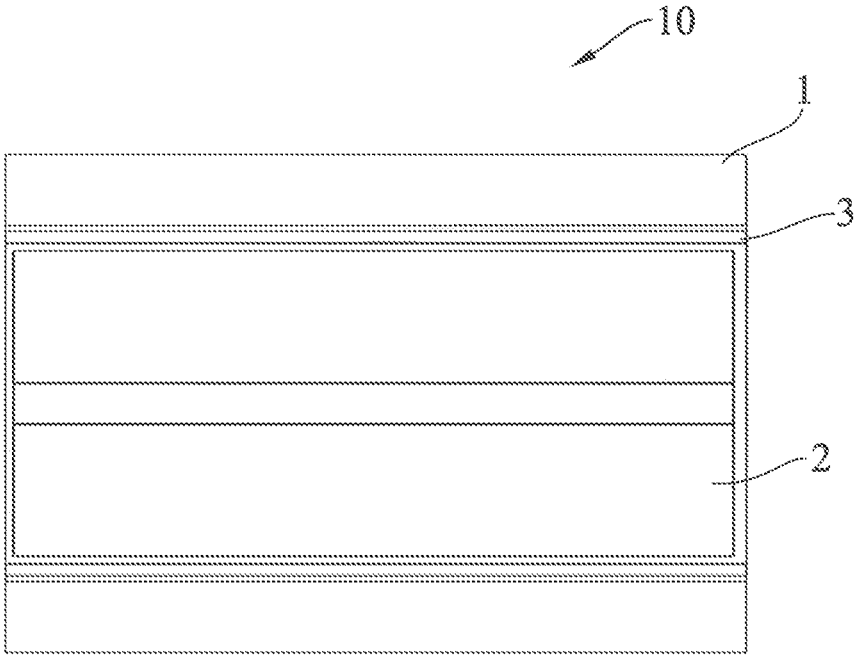
FIG. 2 is a cross-sectional view of the torch system 10 shown in FIG. 1.

FIG. 1 shows a portion of a torch system 10. The torch system 10 includes a cylindrical housing 1, a fuel load 2 located within the cylindrical housing 1, and a protective material 3 that can be provided between the fuel load 2 and the cylindrical housing 1. The protective material 3 can be in the shape of a sleeve that protects the internal surface of the cylindrical housing 1 during activation and burning of the fuel load 2.

In an embodiment, the fuel load 2 may be thermite or other propellant fuel. In the case of the thermite fuel, the ignition of the thermite fuel creates a highly exothermic reaction that produces an abrasive stream of combustion products (e.g., molten fuel or plasma) that forms a precise cut and/or perforation.

The thermite fuel 2 includes a combination or a mixture of a metal and an oxidizer. Examples of such metals can include: aluminum, magnesium, chromium, nickel, silver and/or other metals. Once activated, the thermite fuel can burn at a temperature that may exceed 3000 degrees Celsius. The reaction occurs over a long enough period of time, such that the resultant molten fuel may be directed through a nozzle without causing the external surface to deform due to internal pressure.

With regard to the thermite fuel, when the metal is combined or mixed with the oxidizer, a metal oxide is created that can form, or at least partially form, a combustion product(s). Oxidizers that can be used to oxidize the metal can include, for example: cupric oxide, iron oxide, aluminum oxide, ammonium perchlorate, and/or other oxidizers. Applicant incorporates U.S. Pat. No. 8,196,515, having the title of "Non-Explosive Power Source For Actuating A Subsurface Tool" by reference, in its entirety, herein. The ignition point of thermite can vary, depending on the specific composition of the thermite. For example, the metal and the oxidizer may or may not be combined prior to ignition, which can affect the ignition point. As another example and in regard to thermite mixtures, the ignition point of a thermite mixture of aluminum and cupric oxide is approximately 1200 degrees Fahrenheit, while other thermite mixtures or combinations can have an ignition point as low as 900 degrees Fahrenheit.

When ignited, the thermite produces an exothermic reaction. The rate of the thermite reaction can occur on the order of milliseconds, while, in contrast, an explosive reaction has a rate occurring on the order of nanoseconds. While explosive reactions can create detrimental explosive shockwaves within a wellbore, use of a thermite-based power charge (non-explosive or deflagration reaction) avoids such shockwaves.

The thermite combination can include a polymer, which can be disposed in association with, or as a part of, the thermite combination. The polymer can be of a type that produces a gas responsive to the thermite reaction, which can slow the reaction time of the thermite such that the resultant molten fuel (combustion products) may be directed through a nozzle and onto a target. Usable polymers can include, without limitation, polyethylene, polypropylene, polystyrene, polyester, polyurethane, acetal, nylon, polycarbonate, vinyl, acrylin, acrylonitrile butadiene styrene, polyimide, cylic olefin copolymer, polyphenylene sulfide, polytetrafluroethylene, polyketone, polyetheretherketone, polytherlmide, polyethersulfone, polyamide imide, styrene acrylonitrile, cellulose propionate, diallyl phthalate, melamine formaldehyde, other similar polymers, or combinations thereof.

Both attributes of the molten fuel (i.e., exothermic reaction and subsequent produced stream of combustion products) may act to degrade the wall of the cylindrical housing 1. Therefore, without the protective material 3, and in certain combinations, the wall can be completely breached, resulting in diminished output and compromised cutting and/or perforating performance.

The protective material 3 possesses properties to withstand heat and abrasion. In one embodiment, the protective material 3 can be a carbon fiber tight-mesh weave selected to match the outer diameter of a fuel pellet and the inner diameter of the cylindrical housing 1. In other embodiments, the protective material 3 is formed of carbon fiber, Kevlar, glass fiber, ceramics, carbon, polymer, epoxy, or combinations of these materials. These and other materials for the protective sleeve can be selected based on their thermal and abrasive resistance qualities. The protective material 3 may be applied as a wrap, a sleeve, a spray-on, a paint-on, dipped, or other manufacturing techniques, complimentary to the nature of the material selected. In one embodiment, the protective material 3 can be applied to the outer diameter or an outer layer of the fuel load 2, prior to inserting fuel into the cylindrical housing 1. In another embodiment, the protective material 3 is applied to the inner diameter of the cylindrical housing 1, prior to inserting the fuel load 2 into the cylindrical housing 1.

In an embodiment, the protective material 3 may be of a type that integrates into the combustion products after the fuel load is ignited. For instance, the protective material 3 may decay into part of the stream of combustion products. In this regard, the decaying protective material may provide the same combustion product, a second combustion product, or an added layer of combustion for the fuel load 2. Materials that would cause the protective material 3 to integrate with the combustion products may include graphite and/or carbon fiber. In an embodiment, because the protective material 3 is not a direct additive, for example, a polymer added to thermite, but rather enters or integrates into the combustion products as the protective material decays, a second layer of combustion products may be produced. This second layer of combustion products, formed from the decay and integration of the protective material, can affect the capacity of the fuel required to destroy, cut, perforate, and/or consume the target.

In another embodiment, the protective material 3 may include a retardant that cools the exothermic reaction of the combustion products. The retardant may provide a quenching effect that further protects the cylindrical housing 1 from excessive heat and erosion produced by the combustion products. That is, the retardant material, added to the protective material 3 or forming a part of the protective material 3, may make the reaction of the combustion products more endothermic. Materials for the retardant, forming at least part of the protective material 3, may include: aluminum salts, inorganic phosphates (e.g., refractory salts), anti-sputter material, slag inhibitors, barium sulfate, zinc oxide and trizinc bis-orthophosphate, and combinations thereof.

In a further embodiment, the protective material 3 may be doped or altered with a tracer material that is not consumed or degraded by the combustion products and that serves as an indicator after the cutting and/or perforating process is performed. That is, the tracer material is detectable after the cutting and/or perforating by the torch assembly. For example, the tracer material survives the exothermic reaction of the combustion products to verify the location, depth (undercut or overcut), presence (whether the process actually perforated the target), and/or quality of the cut or perforation. Tracer material forming at least part of the protective material 3 may include: UV (ultraviolet) dies, physical tags, such as micro tags, fire-resistant polymer chips, which may include layers having an infrared identifiable material on one layer, ferromagnetic materials, such as iron, that are detectable with a magnet, radioactive isotope markers, such as radioactive iodine, and combinations thereof.

The thickness of the protective material 3 can be based on the individual properties of the composition of the protective material 3. In one embodiment, the thickness of the protective material 3 can be in the range of 0.0127 cm to 0.0762 cm (0.005 inches to 0.030 inches). The thickness of the protective material 3 may be greater for larger diameter torch systems, and in circumstances in which a longer duration of protection is required due to a higher mass of the fuel load 2. In other embodiments the thickness of the protective material 3 may be up to 0.254 cm (0.100 inches) or greater.

The protective material 3 possesses properties to withstand the large amount of heat produced and the abrasive effects of the combustion product stream. Specifically, the protective material 3 acts as a shield for the cylindrical housing 1 by: (a) increasing the thermal resistance of the cylindrical housing 1 from a combustible fuel source, resulting in a more efficient output and cutting and/or perforating process; and (b) increasing the abrasive resistance of the cylindrical housing from a stream of high temperature, high velocity abrasive particles, again resulting in a more efficient output and cutting process. These advantages offer an additional benefit of allowing the torch system 10 to be designed with added fuel mass that results in increased performance when compared to a torch system that does not have the protective material 3.

While various embodiments of the present invention have been described with emphasis, it should be understood that within the scope of the appended claims, the present invention might be practiced other than as specifically described herein.

What is claimed is:

1. A downhole torch system comprising:

a cylindrical housing;

a fuel load located within the cylindrical housing wherein the fuel load comprises a polymer and is configured to create an exothermic reaction that produces a stream of combustion products when the fuel load is ignited; and a protective material provided between the fuel load and the cylindrical housing, wherein the protective material shields the cylindrical housing from heat and abrasive effects of the combustion products during the exothermic reaction.

2. The downhole torch system of claim 1, wherein the protective material is a carbon fiber tight mesh weave.

3. The downhole torch system of claim 1, wherein the protective material is formed of Kevlar, glass fiber, ceramics, graphite, polymer, epoxy, or combinations thereof.

4. The downhole torch system of claim 1, wherein the protective material is a continuous layer between the fuel load and the cylindrical housing.

5. The downhole torch system of claim 1, wherein the protective material is provided on an outer surface of the fuel load.

6. The downhole torch system of claim 1, wherein the protective material is provided on an inner surface of the cylindrical housing.

7. The downhole torch system of claim 1, wherein the protective material comprises material configured to integrate into the stream of combustion products after the fuel load is ignited.

8. The downhole torch system of claim 7, wherein the integrated protective material produces a second combustion product or an added layer of combustion for the fuel load.

9. The downhole torch system of claim 1, wherein the fuel load is configured to create an exothermic reaction that produces a stream of combustion products when the fuel load is ignited, and the protective material comprises a retardant configured to quench the stream of combustion products adjacent the protective material.

10. The downhole torch system according to claim 1, wherein the fuel load is configured to create an exothermic reaction that produces a stream of combustion products when the fuel load is ignited, and the protective material comprises a tracer material that is not degraded by the stream of combustion products and is detectable after cutting and/or perforating by the torch assembly.

11. A method of assembling a downhole torch system comprising a cylindrical housing, a fuel load comprising a polymer and being configured to create an exothermic reaction that produces a stream of combustion products when the fuel load is ignited, and a protective material, wherein the method comprises:

providing the protective material on at least one of the cylindrical housing and the fuel load, wherein the protective material shields the cylindrical housing from heat and abrasive effects of the combustion products during the exothermic reaction; and inserting the fuel load into the cylindrical housing.

12. The method of claim 11, further comprising providing the protective material on an outer surface of the fuel load before inserting the fuel load into the cylindrical housing.

13. The method of claim 11, further comprising providing the protective material on an inner surface of the cylindrical housing before inserting the fuel load into the cylindrical housing.

14. The method of claim 11, wherein the protective material is a carbon fiber tight mesh weave.

15. The method of claim 11, wherein the protective material is formed of Kevlar, glass fiber, ceramics, graphite, polymer, epoxy, or combinations thereof.

16. The method of claim 11, wherein the protective material comprises material configured to integrate into the stream of combustion products after the fuel load is ignited.

17. The method of claim 16, further comprising integrating the protective material into the stream of combustion products to provide a second combustion product or an added layer of combustion for the fuel load.

18. The method according to claim 11, further comprising quenching the stream of combustion products adjacent the protective material with the protective material comprising a retardant.

19. The method according to claim 11, further comprising wherein the protective material comprises a tracer material that is not degraded by the stream of combustion products and is detectable after cutting and/or perforating by the torch assembly.

* * * * *